US010232486B2

(12) United States Patent
Xue et al.

(10) Patent No.: US 10,232,486 B2
(45) Date of Patent: Mar. 19, 2019

(54) BURR REMOVING DEVICE FOR WHEEL

(71) Applicant: CITIC Dicastal CO.,LTD, Qinhuangdao (CN)

(72) Inventors: Bowen Xue, Qinhuangdao (CN); Jiandong Guo, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 62 days.

(21) Appl. No.: 15/423,708

(22) Filed: Feb. 3, 2017

(65) Prior Publication Data

US 2018/0085882 A1 Mar. 29, 2018

(30) Foreign Application Priority Data

Sep. 24, 2016 (CN) ..... 2016 1 0845452

(51) Int. Cl.

| | |
|---|---|
| ***B24B 5/44*** | (2006.01) |
| ***B24B 9/00*** | (2006.01) |
| ***B24B 29/00*** | (2006.01) |
| ***B24B 41/06*** | (2012.01) |
| ***B24D 13/14*** | (2006.01) |
| ***B24B 9/04*** | (2006.01) |

(52) U.S. Cl.

CPC ..... *B24B 5/44* (2013.01); *B24B 9/00* (2013.01); *B24B 9/04* (2013.01); *B24B 29/005* (2013.01); *B24B 41/06* (2013.01); *B24D 13/145* (2013.01)

(58) Field of Classification Search

CPC ..... B24B 5/44; B24B 9/00; B24B 29/005; B24B 41/06; B24B 9/04; B24D 13/145

USPC ..... 451/194

See application file for complete search history.

(56) References Cited

U.S. PATENT DOCUMENTS

| | | | | |
|---|---|---|---|---|
| 3,258,804 | A * | 7/1966 | Fowle | B24B 5/225 15/104.011 |
| 5,890,952 | A * | 4/1999 | Beaupre | B23Q 3/18 451/168 |
| 5,906,537 | A * | 5/1999 | Elcock | B23C 3/30 451/194 |
| 6,217,424 | B1 * | 4/2001 | Stephens | B24B 5/44 451/254 |
| 6,722,961 | B2 * | 4/2004 | Solanellas | B23Q 1/54 451/140 |
| 9,724,796 | B2 * | 8/2017 | Xue | B24B 9/04 |
| 9,782,866 | B1 * | 10/2017 | Xue | B24B 9/04 |
| 2013/0102233 | A1 * | 4/2013 | Cheon | B24B 27/033 451/331 |
| 2016/0354891 | A1 * | 12/2016 | Xue | B24B 5/44 |

FOREIGN PATENT DOCUMENTS

| | | | |
|---|---|---|---|
| JP | H 03294136 | A * | 12/1991 |
| JP | 3044289 | B2 * | 5/2000 |

* cited by examiner

*Primary Examiner* — Marc Carlson
(74) *Attorney, Agent, or Firm* — Calfee, Halter & Griswold LLP

(57) ABSTRACT

The present invention provides a burr removing device for a wheel. The device comprises a rotary lifting system, a brush moving system, a manipulator system, a clamping drive system and the like. The device can effectively remove burrs on back cavities of wheels with different diameters, the size of the brush moving system can be automatically adjusted, and the angle of a brush I can be flexibly adjusted; meanwhile, the device has the characteristics of high automation degree, advanced process, good removal effect and high safety and stability.

1 Claim, 3 Drawing Sheets

BURR REMOVING DEVICE FOR WHEEL

CROSS-REFERENCE TO RELATED APPLICATIONS

This application claims priority to Chinese Patent Application No. 201610845452.9, filed on Sep. 24, 2016, which is hereby incorporated by reference in its entirety.

TECHNICAL FIELD

The present invention relates to a burr removing device, specifically to a burr removing device for a wheel.

BACKGROUND ART

In the machining process of an aluminum alloy wheel, a large amount of burrs are produced on the cutter outlet side of a spoke at the back cavity of a wheel under the cutting action of a cutter, and the burrs may greatly influence subsequent coating if not removed timely. Burrs are removed on special equipment by using a large disc brush in the traditional burr removing mode, and one brush can only adapt to wheels of one size in such a mode, so the generality is poor, and the corner at the intersection of the rim and the spoke is often not well disposed. In order to solve the problem, many wheel production enterprises are continually seeking a general burr removing device for wheels with different sizes.

SUMMARY OF THE INVENTION

The objective of the present invention is to provide a burr removing device for a wheel. The device can effectively remove burrs on back cavities of wheels with different diameters, the size of a brush moving system can be automatically adjusted, and the angle of a brush I can be flexibly adjusted.

In order to fulfill the above objective, the present invention adopts the technical solution: the device comprises a frame, a driving motor, lifting cylinders, a lower fixed plate, a lifting plate I, guide posts I, guide sleeves I, a bearing seat, a shaft I, a bottom plate, guide rails I, a guide sleeve II, a left moving plate, a guide post II, a spring I, a turning plate, a brush I, a belt pulley I, a synchronous belt, a belt pulley II, a shaft II, a servo motor I, a brush bundle, an iron sleeve, a spring II, a pull rod, a super magnet, pneumatic fingers, an arm, a guide rail II, a servo electric cylinder I, a lifting plate II, guide posts III, guide sleeves III, a right platform, a servo electric cylinder II, an upper fixed plate, racks I, a guide rail III, a left slide plate, a left shaft, left bearing seats, V-shaped rollers, a gear I, a right shaft, right bearing seats, a right slide plate, a clamping cylinder, a servo motor II, a servo motor III, a gear II, a rack II, a servo motor IV, a gear III, a rack III, a guide rail IV, a cover plate, a base plate, a rack IV, a gear IV and a servo motor V, wherein the four guide posts I are fixed between the lower fixed plate and the upper fixed plate, and the four guide sleeves I matched with the four guide posts I are fixed on the lifting plate I; the two lifting cylinders are fixed below the lower fixed plate, and the output end of the two lifting cylinders are articulated with the lower part of the lifting plate I; the driving motor is installed below the lifting plate I via a transition flange; the bearing seat is fixed on the lifting plate I; and the shaft I is installed inside the bearing seat via a bearing.

The brush unit includes: the brush bundle is fixed above the iron sleeve; the pull rod is connected with the lower part of the iron sleeve; the spring II is sleeved outside the pull rod and arranged below the iron sleeve; and the super magnet is fixed below the base plate.

A left brush moving system includes: slide blocks of the two guide rails I are fixed on the bottom plate; the left moving plate is fixed on slide rails of the guide rails I; the servo motor III is installed on the left moving plate, the gear II is installed at the output end of the servo motor III, and the gear II is engaged with the rack II; the rack II is fixed on the left side of the bottom plate; the brush I and the belt pulley II are installed on the shaft II, the shaft II is installed above the turning plate via a bearing; the servo motor I at the output end of which the belt pulley I is installed is fixed on the right side of the turning plate; the belt pulley I is connected with the belt pulley II by the synchronous belt; the lower part of the turning plate is articulated with the left moving plate; the guide post II is fixed below a fixed block on the right side of the turning plate, and the guide sleeve II matched with the guide post II is articulated with the left moving plate; and the spring I is sleeved outside the guide post II.

A right brush moving system includes: a slide block of the guide rail IV is fixed above the bottom plate, and the lower part of the cover plate is fixed on a slide rail of the guide rail IV; a plurality of brush units are installed in the base plate, the base plate is installed inside the cover plate, and T-shaped blocks on two sides of the base plate are matched with open slots on two side of the cover plate; the servo motor IV is fixed on the left side of the lower part of the bottom plate, the gear III is installed at the output end of the servo motor IV, and the rack III engaged with the gear III is fixed inside the cover plate; the servo motor V is fixed on the right side of the lower part of the bottom plate, the gear IV is installed at the output end of the servo motor V, and the rack IV engaged with the gear IV is fixed below the base plate.

A manipulator system includes: the servo electric cylinder II and the two guide sleeves III are fixed below the right platform; the two guide posts III matched with the guide sleeves III are installed below the lifting plate II; the output end of the servo electric cylinder II is articulated with the lower part of the lifting plate II; a slide block of the guide rail II is fixed on the lifting plate II, and a slide rail of the guide rail II is connected with the lower part of the arm; the servo electric cylinder I is installed on the right side of the upper part of the arm, and the output end of the servo electric cylinder I is connected with the right side of the lifting plate II; and five pneumatic fingers are fixed on the left side of the upper part of the arm.

A clamping drive system includes: the left slide plate below which a rack I is fixed is installed on the upper fixed plate via the guide rail III; the two left bearing seats are fixed above the left slide plate; the left shaft on which a V-shaped roller is fixed is installed inside the left bearing seats via bearings; the right slide plate below which a rack I is also fixed is installed on the upper fixed plate via the guide rail III; the two right bearing seats are fixed above the right slide plate; the right shaft on which a V-shaped roller is fixed is installed inside the right bearing seats via bearings; the servo motor II is fixed below the right slide plate, and the output end of the servo motor II is connected with the lower part of the right shaft; the gear I engaged with the racks I on two sides is installed above the upper fixed plate; the clamping cylinder is fixed on the right side of the frame, and the output end of the clamping cylinder is connected with the right slide plate.

In actual use, the type of the wheel is recognized first, the left-right position of the brush I is adjusted via the servo motor III, the gear II and the rack II according to the diameters of the wheel and the flange, and the angle of the brush I can be flexibly adjusted via the guide post II, the guide sleeve II and the spring I, so that the brush I adapts to the corner shape of the rim of the wheel; the left-right position of the cover plate is adjusted via the servo motor IV, the gear III and the rack III, so that the size of the cover plate adapts to the size of the wheel flange; the manipulator system pulls the pull rod down, the super magnet attracts the lower part of the iron sleeve, and the brush bundle is thus pulled into the base plate; the position of the base plate is adjusted via the servo motor V, the gear IV and the rack IV, so that the base plate adapts to the diameter of the wheel; the clamping cylinder enables the left V-shaped roller and the right V-shaped roller to clamp the wheel via the gear I and the racks I; the servo motor II enables the clamped wheel to rotate; the driving motor drives the brush moving system via the shaft I to rotate in a direction opposite to the rotating direction of the wheel, the lifting cylinders enable the brush moving system to rise via the guide post I, and burrs can be removed when the brush I and the brush units contact the back cavity of the wheel.

The device in the present invention can effectively remove burrs on back cavities of wheels with different diameters, the size of the brush moving system can be automatically adjusted, and the angle of the brush I can be flexibly adjusted; meanwhile, the device has the characteristics of high automation degree, advanced process, good removal effect and high safety and stability.

Figure 1:
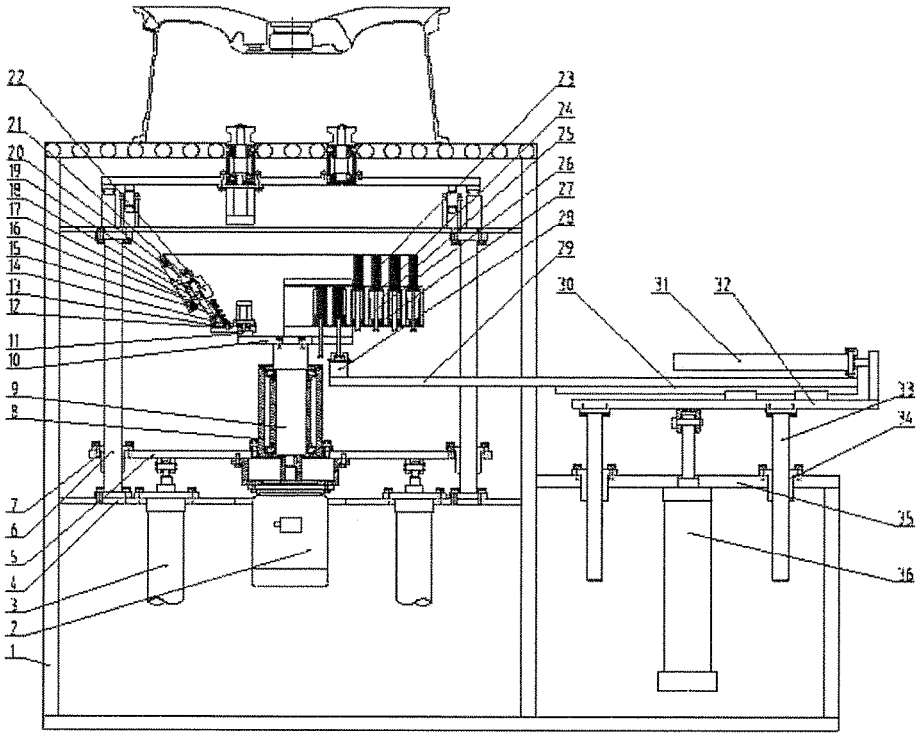
FIG. 1 is a front view of a burr removing device for a wheel in the present invention.
Figure 2:
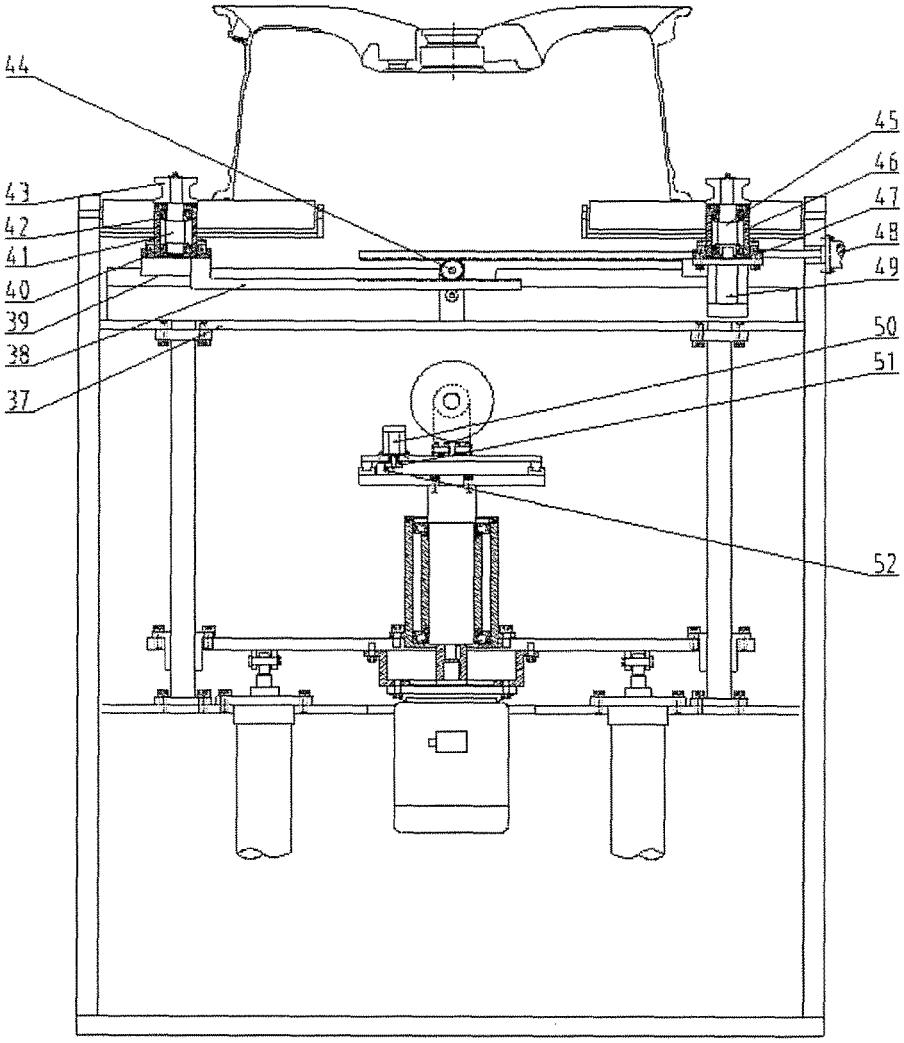
FIG. 2 is a left view of the burr removing device for a wheel in the present invention.
Figure 3:
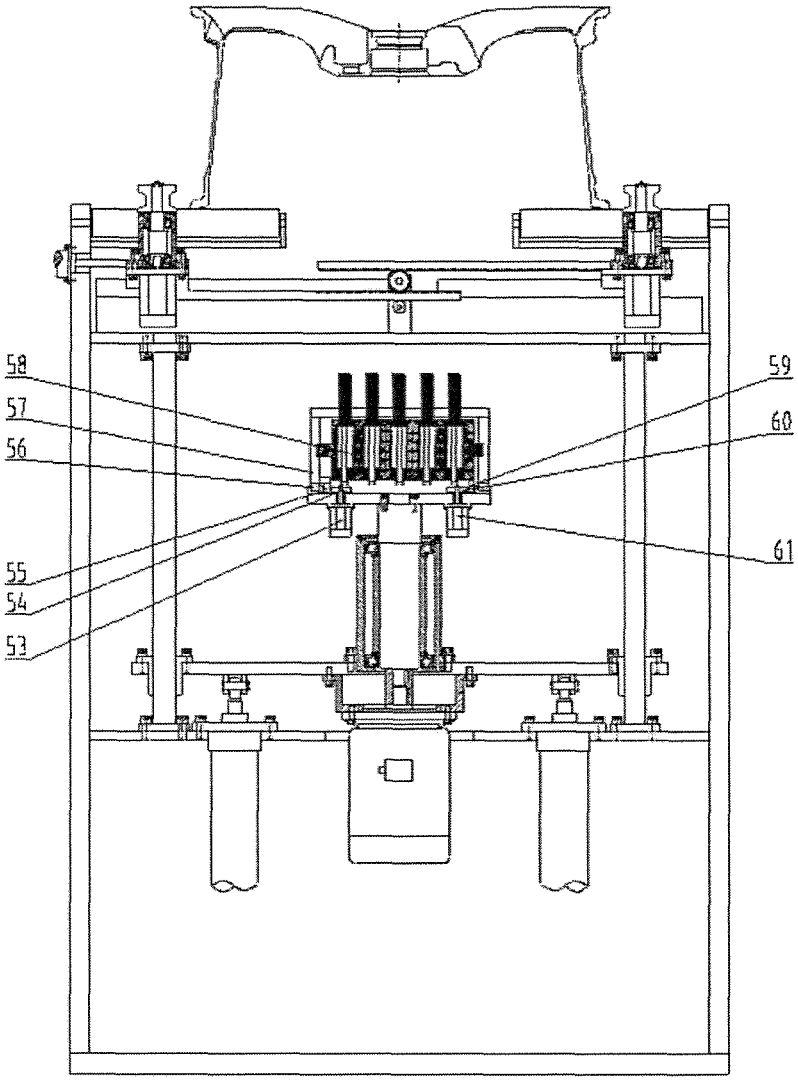
FIG. 3 is a right view of the burr removing device for a wheel in the present invention.

In figures: 1—frame, 2—driving motor, 3—lifting cylinder, 4—lower fixed plate, 5—lifting plate I, 6—guide post I, 7—guide sleeve I, 8—bearing seat, 9—shaft I, 10—bottom plate, 11—guide rail I, 12—guide sleeve II, 13—left moving plate, 14—guide post II, 15—spring I, 16—turning plate, 17—brush I, 18—belt pulley I, 19—synchronous belt, 20—belt pulley II, 21—shaft II, 22—servo motor I, 23—brush bundle, 24—iron sleeve, 25—spring II, 26—pull rod, 27—super magnet, 28—pneumatic finger, 29—arm, 30—guide rail II, 31—servo electric cylinder I, 32—lifting plate II, 33—guide post III, 34—guide sleeve III, 35—right platform, 36—servo electric cylinder II, 37—upper fixed plate, 38—rack I, 39—guide rail III, 40—left slide plate, 41—left shaft, 42—left bearing seat, 43—V—shaped roller, 44—gear I, 45—right shaft, 46—right bearing seat, 47—right slide plate, 48—clamping cylinder, 49—servo motor II, 50—servo motor III, 51—gear II, 52—rack II, 53—servo motor IV, 54—gear III, 55—rack III, 56—guide rail IV, 57—cover plate, 58—base plate, 59—rack IV, 60—gear IV, 61—servo motor V.

DETAILED DESCRIPTION OF THE INVENTION

Details and working conditions of a specific device provided by the present invention will be described below in combination with the accompanying drawings.

The device comprises a frame 1, a driving motor 2, lifting cylinders 3, a lower fixed plate 4, a lifting plate I 5, guide posts I 6, guide sleeves I 7, a bearing seat 8, a shaft I 9, a bottom plate 10, guide rails 111, a guide sleeve II 12, a left moving plate 13, a guide post II 14, a spring I 15, a turning plate 16, a brush I 17, a belt pulley I 18, a synchronous belt 19, a belt pulley II 20, a shaft II 21, a servo motor I 22, a brush bundle 23, an iron sleeve 24, a spring II 25, a pull rod 26, a super magnet 27, pneumatic fingers 28, an arm 29, a guide rail II 30, a servo electric cylinder I 31, a lifting plate II 32, guide posts III 33, guide sleeves III 34, a right platform 35, a servo electric cylinder II 36, an upper fixed plate 37, racks I 38, a guide rail III 39, a left slide plate 40, a left shaft 41, left bearing seats 42, V-shaped rollers 43, a gear I 44, a right shaft 45, right bearing seats 46, a right slide plate 47, a clamping cylinder 48, a servo motor II 49, a servo motor III 50, a gear II 51, a rack II 52, a servo motor IV 53, a gear III 54, a rack III 55, a guide rail IV 56, a cover plate 57, a base plate 58, a rack IV 59, a gear IV 60 and a servo motor V 61, wherein the four guide posts I 6 are fixed between the lower fixed plate 4 and the upper fixed plate 37, and the four guide sleeves I 7 matched with the four guide posts I 6 are fixed on the lifting plate I 5; the two lifting cylinders 3 are fixed below the lower fixed plate 4, and the output end of the two lifting cylinders 3 are articulated with the lower part of the lifting plate I 5; the driving motor 2 is installed below the lifting plate I 5 via a transition flange; the bearing seat 8 is fixed on the lifting plate I 5; and the shaft I 9 is installed inside the bearing seat 8 via a bearing.

The brush unit includes: the brush bundle 23 is fixed above the iron sleeve 24; the pull rod 26 is connected with the lower part of the iron sleeve 24; the spring II 25 is sleeved outside the pull rod 26 and arranged below the iron sleeve 24; and the super magnet 27 is fixed below the base plate 58.

A left brush moving system includes: slide blocks of the two guide rails I 11 are fixed on the bottom plate 10; the left moving plate 13 is fixed on slide rails of the guide rails I 11; the servo motor III 50 is installed on the left moving plate 13, the gear II 51 is installed at the output end of the servo motor III 50, and the gear II 51 is engaged with the rack II 52; the rack II 52 is fixed on the left side of the bottom plate 10; the brush I 17 and the belt pulley II 20 are installed on the shaft II 21, the shaft II 21 is installed above the turning plate 16 via a bearing; the servo motor I 22 at the output end of which the belt pulley 118 is installed is fixed on the right side of the turning plate 16; the belt pulley I 18 is connected with the belt pulley II 20 by the synchronous belt 19; the lower part of the turning plate 16 is articulated with the left moving plate 13; the guide post II 14 is fixed below a fixed block on the right side of the turning plate 16, and the guide sleeve II 12 matched with the guide post II 14 is articulated with the left moving plate 13; and the spring I 15 is sleeved outside the guide post II 14.

A right brush moving system includes: a slide block of the guide rail IV 56 is fixed on the bottom plate 10, and the lower part of the cover plate 57 is fixed on a slide rail of the guide rail IV 56; a plurality of brush units are installed in the base plate 58, the base plate 58 is installed inside the cover plate 57, and T-shaped blocks on two sides of the base plate 58 are matched with open slots on two side of the cover plate 57; the servo motor IV 53 is fixed on the left side of the lower part of the bottom plate 10, the gear III 54 is installed at the output end of the servo motor IV 53, and the rack III 55 engaged with the gear III 54 is fixed inside the cover plate 57; the servo motor V 61 is fixed on the right side of the lower part of the bottom plate 10, the gear IV 60 is installed at the output end of the servo motor V 61, and the rack IV 59 engaged with the gear IV 60 is fixed below the base plate 58.

A manipulator system includes: the servo electric cylinder II 36 and the two guide sleeves III 34 are fixed below the right platform 35; the two guide posts III 33 matched with the guide sleeves III 34 are installed below the lifting plate II 32; the output end of the servo electric cylinder II 36 is articulated with the lower part of the lifting plate II 32; a slide block of the guide rail II 30 is fixed on the lifting plate II 32, and a slide rail of the guide rail II 30 is connected with the lower part of the arm 29; the servo electric cylinder I 31 is installed on the right side of the upper part of the arm 29, and the output end of the servo electric cylinder I 31 is connected with the right side of the lifting plate II 32; and five pneumatic fingers 28 are fixed on the left side of the upper part of the arm 29.

A clamping drive system includes: the left slide plate 40 below which a rack I 38 is fixed is installed on the upper fixed plate 37 via the guide rail III 39; the two left bearing seats 42 are fixed above the left slide plate 40; the left shaft 41 on which a V-shaped roller 43 is fixed is installed inside the left bearing seats 42 via bearings; the right slide plate 47 below which a rack I 38 is also fixed is installed on the upper fixed plate 37 via the guide rail III 39; the two right bearing seats 46 are fixed above the right slide plate 47; the right shaft 45 on which a V-shaped roller 43 is fixed is installed inside the right bearing seats 46 via bearings; the servo motor II 49 is fixed below the right slide plate 47, and the output end of the servo motor II 49 is connected with the lower part of the right shaft 45; the gear I 44 engaged with the racks I 38 on two sides is installed above the upper fixed plate 37; the clamping cylinder 48 is fixed on the right side of the frame 1, and the output end of the clamping cylinder 48 is connected with the right slide plate 47.

In the working process, the type of the wheel is recognized first, the left-right position of the brush I 17 is adjusted via the servo motor III 50, the gear II 51 and the rack II 52 according to the diameters of the wheel and the flange, and the angle of the brush I 17 can be flexibly adjusted via the guide post II 14, the guide sleeve II 12 and the spring I 15, so that the brush I 17 adapts to the corner shape of the rim of the wheel; the left-right position of the cover plate 57 is adjusted via the servo motor IV 53, the gear III 54 and the rack III 55, so that the size of the cover plate 57 adapts to the size of the wheel flange; the manipulator system pulls the pull rod 26 down, the super magnet 27 attracts the lower part of the iron sleeve 24, and the brush bundle 23 is thus pulled into the base plate 58; the position of the base plate 58 is adjusted via the servo motor V 61, the gear IV 60 and the rack IV 59, so that the base plate 58 adapts to the diameter of the wheel; the clamping cylinder 48 enables the left V-shaped roller 43 and the right V-shaped roller 43 to clamp the wheel via the gear I 44 and the racks I 38; the servo motor II 49 enables the clamped wheel to rotate; the driving motor 2 drives the brush moving system via the shaft I 9 to rotate in a direction opposite to the rotating direction of the wheel, the lifting cylinders 3 enable the brush moving system to rise via the guide post I, and burrs can be removed when the brush I 17 and the brush units contact the back cavity of the wheel.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A burr removing device for a wheel comprising a frame, a driving motor, two lifting cylinders, a lower fixed plate, a lifting plate I, four guide posts I, four guide sleeves I, a bearing seat, a shaft I, a bottom plate, two guide rails I, a guide sleeve II, a left moving plate, a guide post II, a spring I, a turning plate, a brush I, a belt pulley I, a synchronous belt, a belt pulley II, a shaft II, a servo motor I, a brush bundle, an iron sleeve, a spring II, a pull rod, a super magnet, pneumatic fingers, an arm, a guide rail II, a servo electric cylinder I, a lifting plate II, two guide posts III, two guide sleeves III, a right platform, a servo electric cylinder II, an upper fixed plate, racks I, a guide rail III, a left slide plate, a left shaft, two left bearing seats, V-shaped rollers, a gear I, a right shaft, two right bearing seats, a right slide plate, a clamping cylinder, a servo motor II, a servo motor III, a gear II, a rack II, a servo motor IV, a gear III, a rack III, a guide rail IV, a cover plate, a base plate, a rack IV, a gear IV and a servo motor V, wherein the four guide posts I are fixed between the lower fixed plate and the upper fixed plate, and the four guide sleeves I matched with the four guide posts I are fixed on the lifting plate I; the two lifting cylinders are fixed below the lower fixed plate, and an output end of the two lifting cylinders are articulated with a lower part of the lifting plate I; the driving motor is installed below the lifting plate I via a transition flange; the bearing seat is fixed on the lifting plate I; the shaft I is installed inside the bearing seat via a bearing;

each of brush unit comprises: the brush bundle is fixed above the iron sleeve; the pull rod is connected with a lower part of the iron sleeve; the spring II is sleeved outside the pull rod and arranged below the iron sleeve; the super magnet is fixed below the base plate;

a left brush moving system comprises: slide blocks of the two guide rails I are fixed on the bottom plate; the left moving plate is fixed on slide rails of the guide rails I; the servo motor III is installed on the left moving plate, the gear II is installed at an output end of the servo motor III, and the gear II is engaged with the rack II; the rack II is fixed on a left side of the bottom plate; the brush I and the belt pulley II are installed on the shaft II, the shaft II is installed above the turning plate via a bearing; the servo motor I at an output end of which the belt pulley I is installed is fixed on a right side of the turning plate; the belt pulley I is connected with the belt pulley II by the synchronous belt; a lower part of the turning plate is articulated with the left moving plate; the guide post II is fixed below a fixed block on a right side of the turning plate, and the guide sleeve II matched with the guide post II is articulated with the left moving plate; the spring I is sleeved outside the guide post II;

a right brush moving system comprises: a slide block of the guide rail IV is fixed on the bottom plate, and a lower part of the cover plate is fixed on a slide rail of the guide rail IV; a plurality of the brush units are installed in the base plate, the base plate is installed inside the cover plate, and T-shaped blocks on two sides of the base plate are matched with open slots on two sides of the cover plate; the servo motor IV is fixed on a left side of a lower part of the bottom plate, the gear III is installed at an output end of the servo motor IV, and the rack III engaged with the gear III is fixed inside the cover plate; the servo motor V is fixed on a right side of a lower part of the bottom plate, the gear IV is installed at an output end of the servo motor V, and the rack IV engaged with the gear IV is fixed below the base plate;

a manipulator system comprises: the servo electric cylinder II and the two guide sleeves III are fixed below the right platform; the two guide posts III matched with the guide sleeves III are installed below the lifting plate II; an output end of the servo electric cylinder II is articulated with a lower part of the lifting plate II; a slide block of the guide rail II is fixed on the lifting plate II, and a slide rail of the guide rail II is connected with a lower part of the arm; the servo electric cylinder I is installed on a right side of an upper part of the arm, and an output end of the servo electric cylinder I is connected with a right side of the lifting plate II; five pneumatic fingers are fixed on a left side of an upper part of the arm;

a clamping drive system comprises: the left slide plate below which a rack I is fixed is installed on the upper fixed plate via the guide rail III; the two left bearing seats are fixed above the left slide plate; the left shaft on which a V-shaped roller is fixed is installed inside the left bearing seats via bearings; the right slide plate below which a rack I is also fixed is installed on the upper fixed plate via the guide rail III; the two right bearing seats are fixed above the right slide plate; the right shaft on which a V-shaped roller is fixed is installed inside the right bearing seats via bearings; the servo motor II is fixed below the right slide plate, and an output end of the servo motor II is connected with a lower part of the right shaft; the gear I engaged with the racks I on two sides is installed above the upper fixed plate; the clamping cylinder is fixed on a right side of the frame, and an output end of the clamping cylinder is connected with the right slide plate;

in actual use, type of the wheel is recognized first, left-right position of the brush I is adjusted via the servo motor III, the gear II and the rack II according to diameters of the wheel and wheel flange, and angle of the brush I can be flexibly adjusted via the guide post II, the guide sleeve II and the spring I, so that the brush I adapts to corner shape of rim of the wheel; left-right position of the cover plate is adjusted via the servo motor IV, the gear III and the rack III, so that size of the cover plate adapts to size of the wheel flange; the manipulator system pulls pull rod down, the super magnet attracts lower part of the iron sleeve, and the brush bundle is thus pulled into the base plate; position of the base plate is adjusted via the servo motor V, the gear IV and the rack IV, so that the base plate adapts to diameter of the wheel; the clamping cylinder enables left one of the V-shaped rollers and right one of the V-shaped rollers to clamp the wheel via the gear I and the racks I; the servo motor II enables clamped wheel to rotate; the driving motor drives the brush moving system via the shaft I to rotate in a direction opposite to rotating direction of the wheel, the two lifting cylinders enable the brush moving system to rise via the guide post I, and burrs can be removed when the brush I and the brush units contact a back cavity of the wheel.

* * * * *